US006047579A

United States Patent [19]

Schmitz

[11] Patent Number: 6,047,579

[45] Date of Patent: Apr. 11, 2000

[54] RF TAG ATTACHED TO DIE ASSEMBLY FOR USE IN PRESS MACHINE

[75] Inventor: Dave Schmitz, Coldwater, Ohio

[73] Assignee: The Minster Machine Company, Minster, Ohio

[21] Appl. No.: 09/062,210

[22] Filed: Apr. 17, 1998

[51] Int. Cl.[7] ..... B21C 51/00

[52] U.S. Cl. ..... 72/15.1; 72/14.8; 72/20.4; 72/21.1; 364/474.21; 364/476.01

[58] Field of Search ..... 72/15.1, 16.1, 72/20.1, 20.2, 20.3, 20.4, 21.1, 21.2, 21.3, 30.1, 31.01, 441, 442, 446, 448; 364/474.21, 476.01; 340/572; 483/1, 28, 29; 83/481, 559; 73/865.9; 11/866.1

[56] References Cited

U.S. PATENT DOCUMENTS

| | | | |
|---|---|---|---|
| 4,283,929 | 8/1981 | Heilberger . | |
| 4,720,907 | 1/1988 | Rapp . | |
| 4,742,470 | 5/1988 | Juengel . | |
| 4,856,177 | 8/1989 | Takeuchi et al. . | |
| 5,214,409 | 5/1993 | Beigel . | |
| 5,540,073 | 7/1996 | Kirii . | |
| 5,564,298 | 10/1996 | De Meo | 72/20.1 |
| 5,574,470 | 11/1996 | de Vall . | |
| 5,595,560 | 1/1997 | Kamada . | |
| 5,622,069 | 4/1997 | Walters . | |
| 5,642,307 | 6/1997 | Jernigan . | |
| 5,661,656 | 8/1997 | Goldman | 72/21.1 |
| 5,666,010 | 9/1997 | Stratiotis | 340/572 |
| 5,682,142 | 10/1997 | Loosmore et al. | 340/572 |
| 5,697,240 | 12/1997 | Parker | 72/31.05 |
| 5,699,046 | 12/1997 | Accolla et al. | 340/572 |
| 5,742,238 | 4/1998 | Fox | 340/572 |
| 5,764,138 | 6/1998 | Lowe | 340/572 |
| 5,774,062 | 6/1998 | Ikefuji | 340/572 |

*Primary Examiner*—Ed Tolan
*Attorney, Agent, or Firm*—Randall J. Knuth

[57] ABSTRACT

A tag for use in a press machine includes a reprogrammable storage area provided in the form of a read/write memory for storing reprogrammable die information associated with the die assembly. A communications device provided in the form of a transceiver transmits die data supplied by the read/write memory and receives data for storage in the read/write memory. The tag, which is integrally attached to one of the die members, establishes a wireless bi-directional communications link with a production monitoring system provided in the form of a reader module integrally associated with the press machine. The reader includes a transceiver arranged for RF communication with the tag transceiver. Die data received by the reader from the tag is supplied to a press controller, which may also provide the reader with information to transmit to the tag.

47 Claims, 3 Drawing Sheets

RF TAG ATTACHED TO DIE ASSEMBLY FOR USE IN PRESS MACHINE

BACKGROUND OF THE INVENTION

1. Field of the Invention

The present invention relates to a tag attached to the tooling components within a stamping or drawing press, and, more particularly, to a bi-directional RF tag configuration that permits die assembly data to be selectively written to and read from a storage area integral with the tag.

2. Description of the Related Art

Conventional press machines employ a tooling apparatus in the form of a die assembly to shape and arrange a workpiece, such as in a stamping or drawing operation. The die assembly typically includes a lower die attached to a non-movable bed or bolster and an upper die attached to a reciprocating slide. The upper and lower dies, which are installed in opposing spaced-apart relation to one another, cooperate during press machine operation to mutually engage the workpiece at respective sides thereof to thereby effect the desired forming activity.

An essential part of proper machine operation involves configuring the press machine in accordance with the die assembly being used. Die assemblies in general cannot simply be interchanged and then put into use without first giving due consideration to how, and to what extent, the press operating parameters may need to be tailored and adjusted to accommodate the installed die assembly. In particular, each die assembly represents a distinct tooling geometry whose corresponding operating specifications must be recognized by the press controller and formulated into the press operating sequence to guarantee that the machine is rendered fit for the scheduled tooling activity and that the die assembly is effectively used. Accordingly, proper press operation requires, among other things, an identification of the particular die assembly currently installed, any press operating guidelines associated with the die assembly, and the workpiece activity about to the undertaken. Since die assemblies typically do not have a universal or standard machine set-up requirement, each die assembly has associated with it a collection of individual press configuration data sets each correlated to a specific machine and defining the manner in which the press machine needs to be configured to achieve structural and operational compatibility with the die assembly in use. A need therefore exists to provide a facility that supplies the press controller with the proper die-related information before the press operation commences.

One conventional approach to supplying such die information uses an identification-type tag integrally attached to one of the die members and which employs, for example, a bar code or magnetic chip arrangement that embodies a coded data pattern uniquely signifying the die assembly. The identification code constitutes a search-type key used by a central machine processor to locate and retrieve the die assembly information corresponding to the target ID. Such information is typically stored in a memory area associated with the machine processor or at another location remote from the ID tag. These code-type forms of ID tags therefore do not carry or contain the requested die information, but instead function simply to provide an identifying key that points the machine processor to the location (e.g., memory address) of the associated die information.

However, such off-tag placement of the essential die set information means that the ID tag itself becomes useless if for reasons such as system failure or communications breakdown the tag-retrieved code is unable to access the central processing facility that houses the code-indexed die information. Additionally, measures must be implemented within the storage area to preserve the integrity of the large volumes of die assembly data covering all of the usable press machines to protect it from corruptibility. Storing the entirety of the die information in one single location presents serious risks to continued system operability in the event of a catastrophic failure affecting the consolidated die data storage area. A need therefore exists to provide a tag operating independently of the reader device (e.g., machine processor) so that it functions as a content-based source of die information. Such an improved tag would compare favorably to current implementations in which no intrinsic die information is furnished but rather a key is provided for indexing a central storage area.

One alternative approach to utilizing a single, machine-based die data storage area involves incorporating a die set data memory within the tag configuration to store certain types of die information. However, the tag-reader combination, and in particular the proposed die set data memory, are arranged and operated such that the die information is formatted and processed solely in a read-only manner. This choice of using a read-only type of die data storage necessarily limits the type of die information that can be contained within the tag and hence provided to the reader. Only data of a fixed and permanently unchanging character may be stored in such a read-only memory, which prevents the tag from providing the machine processor with a full complement of die assembly data, i.e., both fixed and dynamically variable information, that more fully represents the condition and status of the die assembly.

There exists a wide variety of information pertaining to the die assembly that by its very nature is subject to constant revisioning, such as updatable press reconfiguration requirements and maintenance records critical to proper servicing of the die members. The absence of any data recordation feature relating to die within current tag embodiments information constitutes a drawback for any press machine application that needs to be able to selectively and continuously refresh the recorded die set information with revisions, changes, and/or updates. Without this reprogramming ability, it is not possible to perform such tag-resident tasks as supplementing the existing data with newly developed die information and inserting additional data on reconfiguring the press machine and/or die assembly. Accordingly, a need exists to provide a tag that continues to support a data retrieval function (e.g., a readable memory) but that now permits die information to be selectively revised and recorded therein.

Another drawback of conventional tag units concerns the form of interconnectivity required to establish communications between the tag and reader. The type of interface used in certain tag embodiments such as a bar code or magnetic chip involves a direct physical connection between the components, making access to the tag difficult once the die members are installed. Even if the tag can be suitably accessed, the need for a direct physical connection nevertheless serves as another design consideration that must be taken into account when integrating the tag into the die assembly. A need therefore exists for a system that proposes to eliminate such physical connectivity between the tag and reader device while still supporting communications between the components after installation of the die members and the integrally attached tag.

In one approach designed to alleviate any tag-reader communication problems accompanying the installation arrangement, it has been proposed that access to the tag be undertaken prior to installation while the die assembly is still housed in its magazine. However, this arrangement may not be acceptable if the reader device does not operate in such a portable, mobile fashion but instead is fixedly and integrally secured to the machine in a manner that establishes access with the tag only after installation (e.g., when a line-of-sight communications link is utilized).

SUMMARY OF THE INVENTION

According to the present invention there is provided a tag for use in a press machine and which is integrally secured to the die assembly. The tag includes a reprogrammable storage area preferably provided in the form of a read/write memory for storing die information associated with the die assembly, such information comprising data representing characterizing attributes of the die assembly. The read/write memory may also store machine information representing characterizing attributes of at least one press machine operatively configurable with the die assembly. A communications device preferably provided in the form of a transceiver, transmits die data supplied by the read/write memory and receives data for storage in the read/write memory. The tag preferably establishes a wireless bi-directional communications link with a production monitoring system provided in the form of a reader module associated with the press machine. The reader includes a transceiver arranged for RF communication with the tag transceiver. Die data received by the reader from the tag is supplied to a press controller, which may also provide the reader with information to transmit to the tag.

The invention, in one form thereof, comprises a tag associated with a die assembly, such tag including a reprogrammable memory and a communication means for transmitting data provided by the reprogrammable memory and for receiving data for providing to the reprogrammable memory, wherein data provided to the tag for storage in the reprogrammable memory includes die information associated with the die assembly. The die information associated with the die assembly, in one form thereof, further comprises information representing characterizing attributes of the die assembly. The data stored by the reprogrammable memory, in one form thereof, further comprises machine information representing characterizing attributes of at least one press machine operatively configurable with the die assembly.

The reprogrammable memory, in one form thereof, includes a read/write memory. The communication means, in one form thereof, includes a wireless communications capability. A means is provided for selectively reprogramming the reprogrammable memory using the data received by the communication means.

The invention, in another form thereof, comprises a tag associated with a die assembly, such tag including a first means for storing data in a modifiable manner and a second means for transmitting data provided by the first means and for receiving data for the first means, wherein data provided to the tag for storage in the first means includes die information associated with the die assembly. The die information associated with the die assembly further comprises information representing characterizing attributes of the die assembly. The data stored by the first means further comprises machine information representing characterizing attributes of at least one press machine operatively configurable with the die assembly.

In one form thereof, the first means includes a read/write memory and the second means includes a wireless communications device. A processor is provided to selectively modify the contents of the first means using the data received by the second means.

The invention, in another form thereof, comprises a tag apparatus associated with a die assembly, such tag apparatus including a read/write memory and a communications device being arranged in data-transfer relationship with the read/write memory and having a transmit/receive capability, wherein data received by the communications device for transfer to the read/write memory includes die information associated with the die assembly. The die information associated with the die assembly includes information representing characterizing attributes of the die assembly, while the data stored by the read/write memory includes machine information representing characterizing attributes of at least one press machine operatively configurable with the die assembly.

The communications device includes a wireless transmit/receive operating capability. A processor is provided to selectively reprogram the contents of the read/write memory using data received by the communications device.

The invention, in another form thereof, includes a tag associated with a die assembly, such tag comprising a storage means for reprogrammably storing data and a communications device being adapted to transmit data provided by the storage means and being adapted to receive data for providing to the storage means, wherein data provided to the tag for storage in the storage means includes die information associated with the die assembly. The die information associated with the die assembly includes information representing characterizing attributes of the die assembly, while the data stored by the storage means includes machine information representing characterizing attributes of at least one press machine operatively configurable with the die assembly.

The storage means, in one form thereof, includes a read/write memory. The communications device includes a wireless transmit/receive operating capability. A means is provided for selectively reprogramming the storage means using the data received by the communications device.

The invention, in yet another form thereof, is directed to a system for use with a press machine associated with a die assembly, such system comprising a tag integrally associated with the die assembly, the tag including a reprogrammable memory, wherein data provided to the tag for storage in the reprogrammable memory including die information associated with the die assembly, and a communications device arranged in data-transfer relationship with the reprogrammable memory and having a transmit/receive capability; and a communication means associated with the press machine and arranged to establish with the communications device of the tag a bi-directional communications link. The die information associated with the die assembly includes information representing characterizing attributes of the die assembly, while the data stored by the reprogrammable memory includes machine information representing characterizing attributes of at least one press machine operatively configurable with the die assembly.

The communications device of the tag and the communication means associated with the press machine, in one form thereof, establish a wireless link. The reprogrammable memory, in one form thereof, includes a read/write memory. There is further provided a means, arranged for communication with a press controller associated with the press machine, for providing the communication means with die information associated with the die assembly for transmission to the tag.

The invention, in another form thereof, includes a system for use with a press machine associated with a die assembly. The system includes a tag integrally associated with the die assembly, such tag comprising a first means for storing data in a modifiable manner, wherein data provided to the tag for storage in the first means including die information associated with the die assembly, and a second means for transmitting data provided by the first means and for receiving data for the first means; and a reader associated with the press machine, such reader comprising a third means arranged for establishing with the second means of the tag a bi-directional communications link. The die information associated with the die assembly includes information representing characterizing attributes of the die assembly, while the data stored by the first means includes machine information representing characterizing attributes of at least one press machine operatively configurable with the die assembly.

The first means of the tag, in one form thereof, includes a read/write memory. The second means of the tag and the third means of the reader establish a wireless communications link therebetween. There is further provided a processor, associated with the tag, to selectively modify the contents of the first means using the data received by the second means. The reader further includes a fourth means, arranged for communication with a press controller associated with the press machine, for providing the third means of the reader with die information associated with the die assembly for transmission to the tag.

The invention, in another form thereof, comprises an apparatus for use with a press machine associated with a die assembly. The apparatus includes a read/write memory integrally associated with the die assembly, wherein data provided to the read/write memory for storage therein including die information associated with the die assembly; a first communications device integrally associated with the die assembly, the first communications device being arranged in data communicative relationship with the read/write memory and having a transmit/receive capability; and a second communications device associated with the press machine, the second communications device being arranged to provide a bi-directional communications link with the first communications device. The die information associated with the die assembly includes information representing characterizing attributes of the die assembly, while the data stored by the read/write memory includes machine information representing characterizing attributes of at least one press machine operatively configurable with the die assembly.

The bi-directional communications link provided by the first communications device and the second communications device includes a wireless link. The system further includes a processor integrally associated with the second communications device and arranged for communication with a press controller associated with the press machine. There is provided an auxiliary storage device arranged to selectively receive data received by the second communications device from the first communications device.

The invention, in yet another form thereof, includes a system for use with a press machine associated with a die assembly, such system comprising a tag integrally associated with the die assembly, the tag including a storage means for reprogrammably storing data, wherein data provided to the tag for storage in the storage means includes die information associated with the die assembly, and a first transmit/receive communications means arranged in data-transfer relationship with the storage means; and a reader associated with the press machine, the reader comprising a second transmit/receive communications means arranged to establish with the first transmit/receive communications means of the tag a bi-directional communications link. The die information associated with the die assembly includes information representing characterizing attributes of the die assembly, while the data stored by the storage means includes machine information representing characterizing attributes of at least one press machine operatively configurable with the die assembly.

The first transmit/receive communications means of the tag and the second transmit/receive communications means of the reader establish a wireless link. The storage means, in one form thereof, includes a read/write memory.

One advantage of the present invention is that the improved tag configuration enables die information to be selectively read from and written to the reprogrammable storage area.

Another advantage of the present invention is that die assembly information stored locally within the tag can now be selectively and continuously reprogrammed, permitting a range of die assembly data operations heretofore not available, such as updates, deletions, insertions, additions, changes, revisions, counters, and other forms of modifications.

Another advantage of the present invention is that the tag can store an expandable and modifiable number of press configuration data sets that facilitates rapid reconfiguration of the press machine by simply accessing the machine-specific data from the tag memory and forwarding this information to the press controller.

A further advantage of the invention is that the bi-directional communications link established between the tag and reader permits a more complete exchange of information, which increases the efficiency and accuracy of the die installation and press reconfiguration activities and provides both the tag and reader with the ability to dynamically revise and modify their respective storage areas with the most recently updated information.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
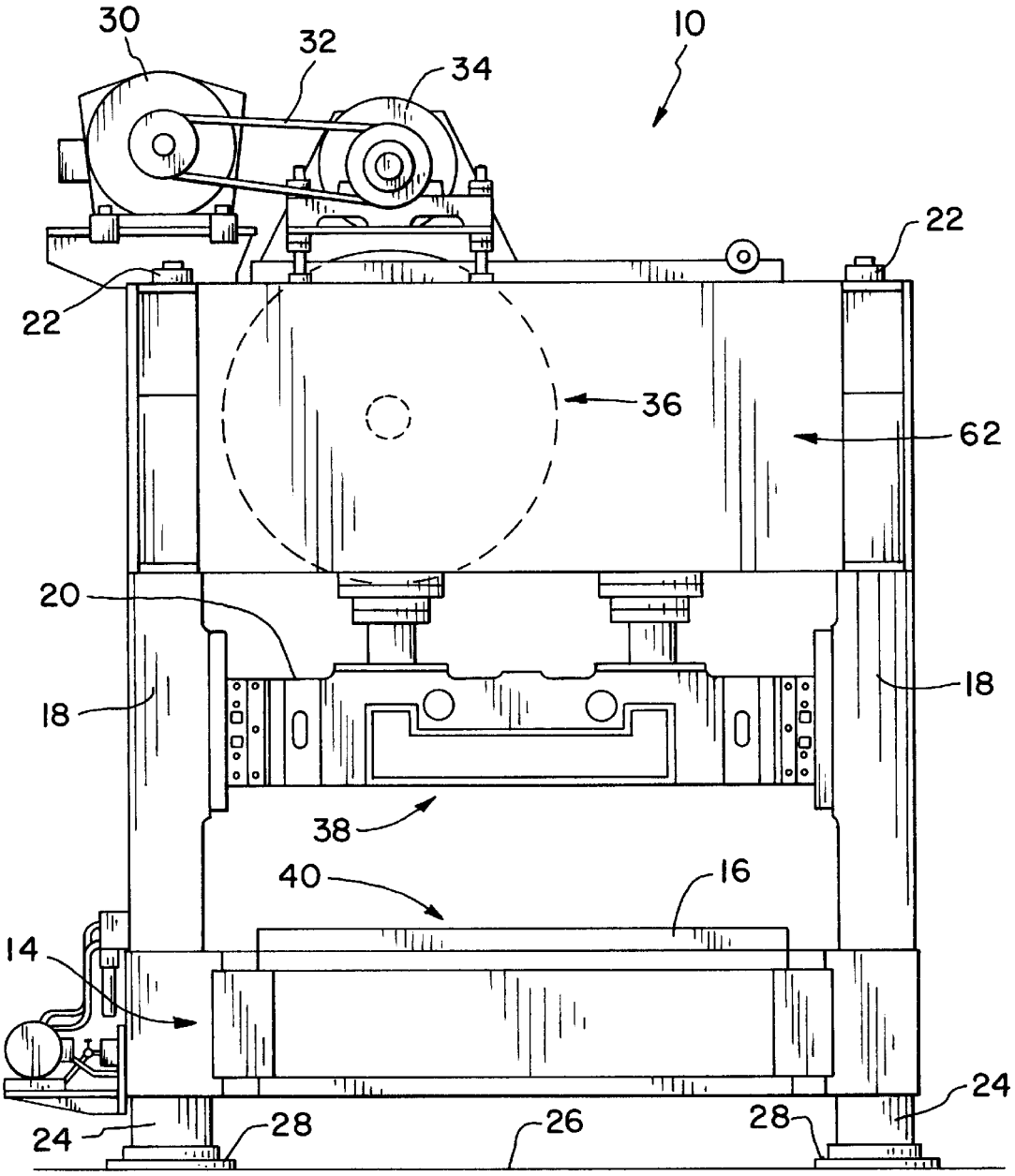
FIG. 1 is an elevational front view of a press machine incorporating the present invention in one illustrative form thereof.

Reference is first made by way of background to FIG. 1, in which there is shown a mechanical press 10 of conventional form including a crown portion 12, a bed portion 14 having a bolster assembly 16 connected thereto, and uprights 18 connecting crown portion 12 with bed portion 14. Uprights 18 are connected to or integral with the underside of crown 12 and the upper side of bed 14. A slide 20 is positioned between uprights 18 for controlled reciprocating movement between crown 12 and bed 14. Tie rods (not shown), which extend through crown 12, uprights 18 and bed portion 14, are attached at each end with tie rod nuts 22. Leg members 24 are formed as an extension of bed 14 and are generally mounted on shop floor 26 by means of shock absorbing pads 28. A drive press motor 30, which is part of the drive mechanism, is attached by means of a belt 32 to an auxiliary flywheel 34 attached to crown 12. Auxiliary flywheel 34 is connected by means of a belt (not shown) to the main flywheel of the combination clutch/brake assembly, depicted generally at 36. Press machine 10 is described herein for illustrative purposes only as it should be apparent that the tag according to the present invention may be used in conjunction with any type of press machine.

Press machine 10, when fully configured with a die assembly installed therein, further includes an upper die (not shown) located at area 38 and attached by known means in a conventional manner to the lower end of slide 20. A lower die (not shown) located at area 40 is attached by known means in a conventional manner to the upper end of bolster 16. The upper and lower dies, as so arranged in their opposing spaced-apart relationship, cooperate in a known manner during press operation to process a workpiece disposed therebetween, e.g., secured to the lower die. The upper and lower dies together constitute a die set or assembly in which the tag of the present invention is integrally secured to at least one of the die assembly members. The present invention is not limited to any particular form or type of die assembly but may be integrated with any die assembly arrangement.

Figure 2:
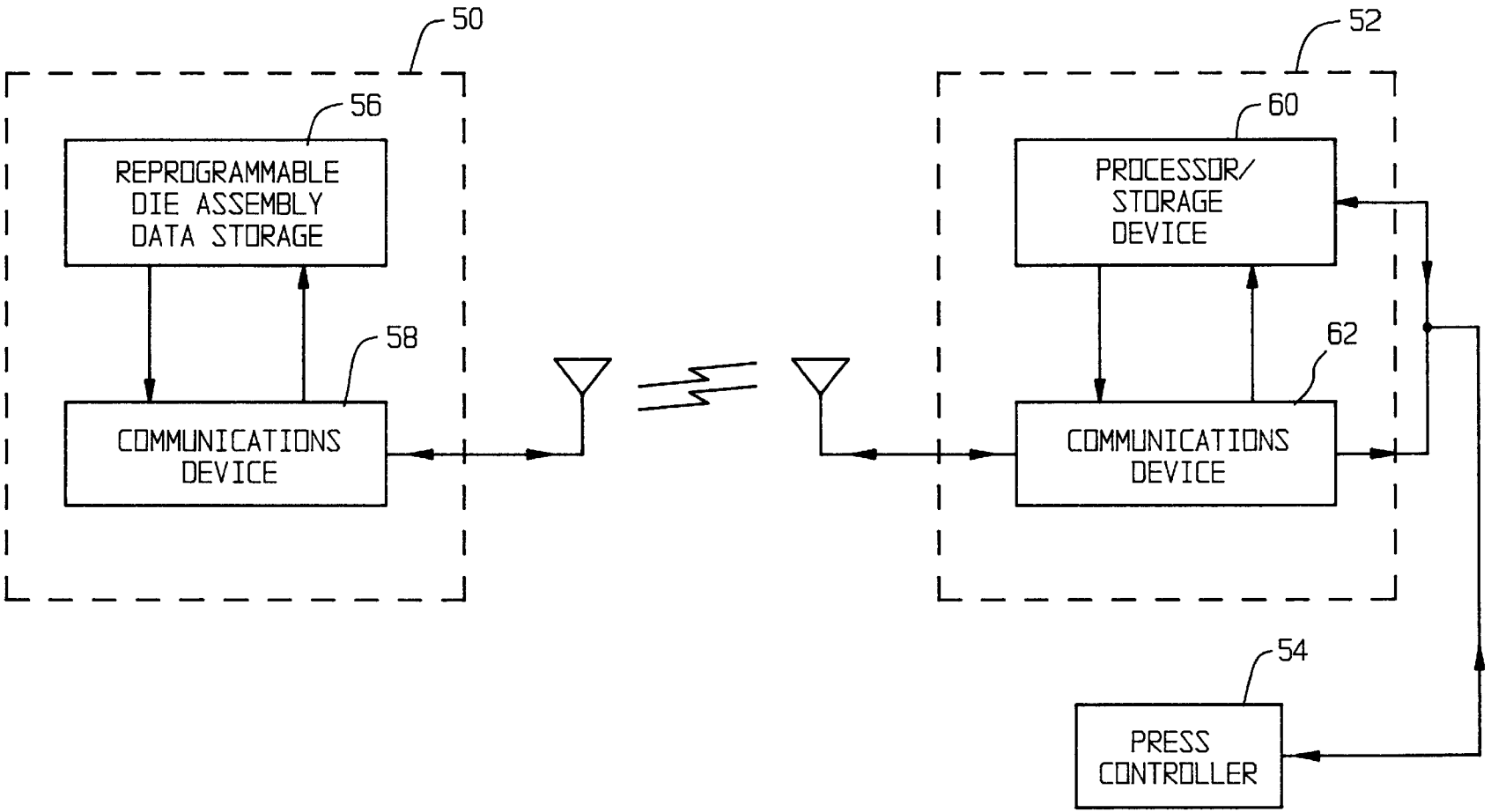
FIG. 2 is a block diagram illustration of a system according to one embodiment of the present invention for use in the press machine of FIG. 1, depicting in one illustrative form thereof, the cooperative relationship between the tag components integral with the die assembly and the reader components integral with the press machine.

Referring now to the drawings and particularly to FIG. 2, there is shown in block diagram format a system according to the present invention for use in a press machine and, more specifically, in association with a die assembly configured with the press machine. The illustrated system includes a tag module 50 integrally associated with the die assembly and arranged for secured attachment to at least one of the die assembly members. The system further includes a reader module 52 arranged for communication with tag module 50 to establish, in combination, a bi-directional communications link in which data may be exchanged between the illustrated units, such as information relating to the installed die assembly. Reader 52, in one form thereof, is associated with the press machine and disposed for communication with press controller 54.

Tag 50, in accordance with the present invention and as described below in further detail, provides a facility by which information associated with the die assembly can be dynamically and controllably reprogrammed. As used herein, the reprogrammable feature should be understood as encompassing the entire range of data processing/manipulation methods and programming functions connected with the storage, recordation, modification, and retrieval of data. In particular, tag 50 provides, in one form thereof, a reprogrammable memory that enables data operations to be performed, particularly with respect to information associated with the installed die assembly, which include, but are not limited to, operations allowing data to be stored, altered, supplemented, inserted, saved, added, removed, modified, counted, accumulated, or otherwise processed. As will be described below, this reprogrammability finds notable advantages with respect to the treatment of data concerning the die assembly to which tag 50 is attached, although this particular aspect should not be considered in limitation of the present invention as any other type of information may be processed in an equivalent manner, e.g., press machine reconfiguration data. Tag 50, in one alternative understanding, may be considered as providing a means for storing data in a modifiable manner. Additionally, tag 50, in another alternative understanding, may be considered as supporting a functionality enabling data to be selectively written to and read from an integral storage area.

As used herein, references to die information associated with the die assembly relate to categories of data including, among other things, information linked specifically to a corresponding set of die elements and representing an attribute thereof ("die-characteristic data"); and information not specifically disclosing a defining attribute of the die assembly but representing information that is dependent upon a particular set of die elements ("die-dependent data"). Such die-characteristic data relates to information representing characterizing attributes of the die assembly and may include, but is not limited to, maintenance information concerning the number of parts and/or workpieces manufactured and/or processed by the relevant die assembly; safety, diagnostic, warranty and other manufacturer-provided servicing information; specification data describing the geometry, structure, and other physical properties of the die members (e.g., material, mechanical design); and other information that by its nature and relation to the die assembly constitutes an attribute or parameter which proposes to characterize an identifiable set of die members or represents an intrinsic characteristic of the die assembly for uniquely and/or distinctly identifying or describing it.

Die-dependent data relates to information that is specifically associated with an identifiable set of die members but which does not propose to represent an attribute intrinsic to the die members. For example, die-dependent data may include, but is not limited to, information relating to the manner of configuring the press machine to accommodate the die assembly currently in use. This information may encompass structural and/or mechanical reconfiguration data for modifying the press machine arrangement in accordance with the die assembly; and operational data governing the manner of how to control the press machine to ensure that the press machine and die assembly cooperate effectively in performing the tooling activity. In this regard, die-dependent data may be considered to include, in one form thereof, machine information representing characterizing attributes of a distinct press machine operatively configurable with the die assembly. Preferably, plural sets of such machine information are associated with the die assembly and saved in tag 50 to facilitate the installation of the die assembly in a corresponding array of press machines. In particular, tag 50 of the present invention enables data to be stored therein concerning information for loading the accompanying die assembly to a number of different press machines. Machine information such as the press reconfiguration data more properly characterizes attributes of the press machine, although the attributes themselves are a function of (i.e., dependent upon) the die assembly in use. The advantage obtained by storing such multi-machine die-loading information in tag 50 lies in the immediate availability of all of the necessary information for quickly reconfiguring the press machine into which the attached die assembly is installed. The currentness of the reconfiguration data is virtually guaranteeable since the bi-directional communications link and reprogrammable storage 56 operate cooperatively to allow the most recent revisions to be reflected in storage 56.

In accordance with another aspect of the present invention, it should be understood that the die information includes individual data items of a type that may be considered fixed (i.e., typically not subject to change) and variable (i.e., subject to change and/or modification). Further examples of die information associated with the die assembly include, but are not limited to, press serial number; total parts made with the die assembly (both upper and lower die members); start-up speed and continuous speed for the press machine (i.e., reciprocating slide); shutheight value for both the upper and lower dies; counterbalance pressure; feed length for both the upper and lower die members; feed rate; feed line height; and feed stock guide. Among this listing of data items, it may be considered, for illustrative purposes only, that the feed parameters, shutheight values, and total parts made represent die-characteristic data, while the speed requirements and pressure specifications represent die-dependent data. Information such as press serial number belong to another distinct data category, namely machine-related information derived independently from the particular installed die set. One example of data is shown in Appendix A.

Memory Words 27–30 of Appendix A refer to a piece of auxiliary equipment referred to as a "Straightener". This unit's purpose is to flatten the material as it is being unwound from the coil of steel. There are specific dimension's of setup information which is recalled with the die information. These setup dimensions are "shared" with the straightener in one of two ways. The first method is a manual system, where the press operator refers to the operator interface screen and retrieves the setting of the "work rolls" of the straightener. The second method would employ a more automated system where as the information is "passed" to the straightener system, via a communication network, after which the straightener control system would automatically adjust to the settings.

Words 51–102 of the memory map are shown in Appendix A contain the values of the "Programmable Limit Switch" (PLS) parameters, which are used to control auxilary equipment on or around a press. The PLS is used to control the pieces of auxilary equipment which require a signal from the press, in regard to the position of the press. Such items of control would include blowoffs, feed angle, roll lift, part knockouts, and other items.

Words 110–163 of the memory as represented by Appendix A contain the setup information for the "Die Protection" aspect of the control. The purpose of die protection is to allow the user to embed sensors within the die, and "check" these sensors to verify the process is performing as it is designed. The die protection system is composed of (for example) 16 inputs, which are independently configurable by the end user.

Words 170–192 of the memory device as represented by Appendix A contain the setup information of the "tonnage monitoring" system. The tonnage monitoring unit "reads" the amount of work being done within a die, by monitoring strain links mounted on the press frame. The tonnage monitor will "report" and stop the process in the event of an increase, or decrease in press tonnage.

Referring again to FIG. 2, the illustrated tag 50 includes a reprogrammable die assembly data storage 56 arranged in data-transfer relationship with a communications device 58. These components are preferably arranged in integral combination to form a single, integrated module. The integrated tag module is preferably integrally secured to one of the die assembly members by any suitable attachment technique of conventional application, although it should be understood that the manner of such attachment does not form part of the present invention and therefore should not be viewed in limitation thereof. The manner of attachment, in one aspect thereof, is selected with a view towards facilitating and permitting communications between tag 50 and reader 52.

The illustrated reprogrammable storage 56 is provided in the form of a storage or memory area embodying a functionality that permits data, in a general sense, to be selectively read from and written to the memory area. Reprogrammable storage 56, in one aspect thereof, allows data to be stored therein in any conventional manner suitable for retrieval (i.e., in connection with a read function), preferably in a non-volatile recording format. Such data recordation encompasses not only any initial programming of the memory area but also any dynamic reformatting of the memory area (e.g., inserting additional or supplemental data) during operation of tag 50. Reprogrammable storage 56, in another aspect thereof, supports the ability of data stored therein to be processed in a manner including, but not limited to, reprogramming operations such as data revisions, modifications, alterations, substitutions, replacements, updates, and/or erasures, whether executed individually, in sequence, or in selected combination thereof.

Reprogrammable storage 56 should be considered as encompassing any means having a readable/rewritable feature in regard to the management, storage, recordation, retrieval, and modification/alteration of data. The reprogrammability may be embodied in forms including, but not limited to, implementations based on hardwiring (e.g., hardware-based), firmware, software, or any combination thereof. For example, reprogrammable storage 56 may be reprogrammed by using standard reprogramming circuitry that connects directly to storage 56 or by invoking a software function that executes the appropriate instruction sets to carry out the selected data operation. The data that is applied to reprogrammable storage 56, in a preferred form thereof, arrives by way of transmissions from reader 52 to tag 50 over the bi-directional communications link. Reprogrammable storage 56, in illustrative forms thereof, may be provided in the form of a read/write memory, an electrically-erasable-programmable read-only memory (EEPROM), or any other reprogrammable type of memory. Reprogrammable storage 56 may be accompanied by or have incorporated therein a memory portion that constitutes a non-reprogrammable type of memory (e.g., a strictly read-only memory). The reprogramming of reprogrammable storage 56, in a preferred form thereof, occurs in response to and in accordance with the data provided to tag 50 from reader 52 over the bi-directional communications link.

In accordance with another aspect of the present invention, the data-modifiable feature of reprogrammable storage 56 is particularly effective and applicable to die assembly information, both of the die-characteristic and die-dependent types, that remains subject to review and possible updating/modifying during the course of communication activity involving tag 50, either by way of user input or in a more controlled way through operation of press controller 54 or another processor-type arrangement. For example, reprogrammable storage 56 may be continuously updated with revisions reflecting any changes to the current total of parts made with the corresponding die assembly, in which such revisions are preferably provided to tag 50 from reader 52 over the bi-directional communications link. Reprogrammable storage 56, in one illustrative form thereof, may be organized in a manner similar to the mapping layout of Appendix A herein such that certain data items are known to be stored or located at corresponding memory addresses. This illustrative addressing format facilitates changes to individual data items by simply referring the data operation of interest to the relevant data address(es). For example, when updates are being made to the parts total, the revisions are reflected in data modifications/substitutions to the values stored in the addresses for words 3 and 4. The data stored in reprogrammable storage 56 may be further organized in other known conventional ways to facilitate the accessing, searching, and retrieval of information, such as by incorporating another layer of data organization and management using files or folders.

The illustrated communications device 58 is arranged to transmit data provided by reprogrammable storage 56 and to provide reprogrammable storage 56 with data it receives. The transmission and reception of data by communications device 58 occurs in connection with the bi-directional communications link established with reader 52. The communications link is preferably of the wireless type, although other forms of communication are possible provided that the communications devices are suitably adapted for such use. In a wireless implementation, communications device 58 is preferably provided in the form of an RF transceiver. Conventional means (not shown) are used to implement whatever communication and signal processing techniques are deemed appropriate or suitable, such as signal modulation/demodulation and data encoding/decoding, particularly if data communications occur in a digital format. These system parameters, however, do not form a part of the present invention and should not be used in limitation thereof.

Referring again to FIG. 2, the illustrated reader 52 represents the module with which tag 50 communicates in the manner of exchanging data therebetween. Accordingly, reader 52 encompasses other such arrangements or means that establish with tag 50 a bi-directional communications link. Reader 52 is preferably associated (e.g., integrally arranged) with the particular press machine in which is configured the die assembly having tag 50 secured thereto. Reader 52, in one illustrative form thereof, includes a processor/storage device 60 and communications device 62, which is arranged for communication with communications device 58 of tag 50 to establish the bi-directional communications link therebetween. Communications device 62 is preferably provided in the form of an RF transceiver. Processor 60 represents a means by which data received by communications device 62 can be processed and stored therein or forwarded to another subsystem, such as press controller 54 or a supplemental storage location. Processor 60, in another mode thereof, can function to provide communications device 62 with data for transmission to tag 50. Such transmissible data may originate from processor 60, press controller 54, or some other data-providing means (e.g., a user-activated input device) and preferably constitutes die information associated with the die assembly, in accordance with the present invention. One type of tag useful for the present invention is an INTELLITRAC™ manufactured by Allen Bradley Co. of Rockwell Automation. In the event communications device 62 is arranged to communicate directly with press controller 54, processor 60 may be considered optional.

During operation, any number and type of requests for data, responses to such data interrogations, and bi-directional exchanges of data, particularly die information associated with the die assembly, are supportable by the illustrated system comprising tag 50 and reader 52. For example, after the die assembly and integrally attached tag 50 are installed in the designated press machine, press controller 54 may initiate a request for data from tag 50 with regard to information stored therein detailing the manner of reconfiguring the press machine to accommodate the installed die assembly. This request, suitably formatted, is transmitted by communications device 62 to tag 50. At tag 50, communications device 58 receives the incoming transmission and provides the imbedded data request to reprogrammable storage 56, whereupon the proper data is retrieved therefrom in accordance with the data request, forwarded to communications device 58 for return transmission to communications device 62 in reader 52, and ultimately provided to press controller 54, which uses the information to implement any indicated reconfiguration requirements. At the front end of the original transmission, processor 60 may play a role in formatting the data request or otherwise preparing the request for transmission to and recognition by tag 50. It is preferable after installation of the combined die set and integrally attached tag 50 for there to be executed an identification procedure in which the identity of the installed die set, which is preferably stored in reprogrammable storage 56, be conveyed to reader 52 automatically or in response to an ID (identification) interrogation.

The rewritable feature of reprogrammable storage 56 may be illustrated by the operational sequence attending the modification of the parts total in accordance with updates thereof. The revisions may be implemented, in alternative forms thereof, by an incrementing step that is executed in response to an instruction command originating internally within tag 50 or externally from tag 50, such as from processor 60 or a user input device adapted for communication with communications device 62. In one form, the internal command can self-execute once it is determined that the accompanying die assembly has finished a tooling operation. Alternatively, the external command can be formulated on the reader side and then transmitted over the bi-directional communications link to tag 50, which acts in response to the command to properly amend the relevant data item(s) in reprogrammable storage 56.

The features of the present invention directed to providing tag 50 with reprogrammable storage 56 and arranging tag 50 for bi-directional communication with reader 52 essentially serve to provide tag 50 with a configuration that enables it to function, in a preferred form thereof, as a single-source, content-based provider of modifiable data, which realizes its most important advantages in regard to the storage and processing of die information associated with the die assembly. As a result, all of the die information pertaining to the die assembly may be contained within tag 50 at reprogrammable storage 56, while enabling the possibility that any changes or additions thereto may be incorporated simply by communicating such modifications over the bi-directional communications link from reader 52 or from any other such facility arranged for communication with tag 50. The single sourcing of all die information (i.e., fixed and variable) afforded by reprogrammable storage 56 enables press controller 54 and other networked devices to have a single site from which any necessary die information can be retrieved, namely tag 50, thereby simplifying the accompanying data access and retrieval functions.

Figure 3:
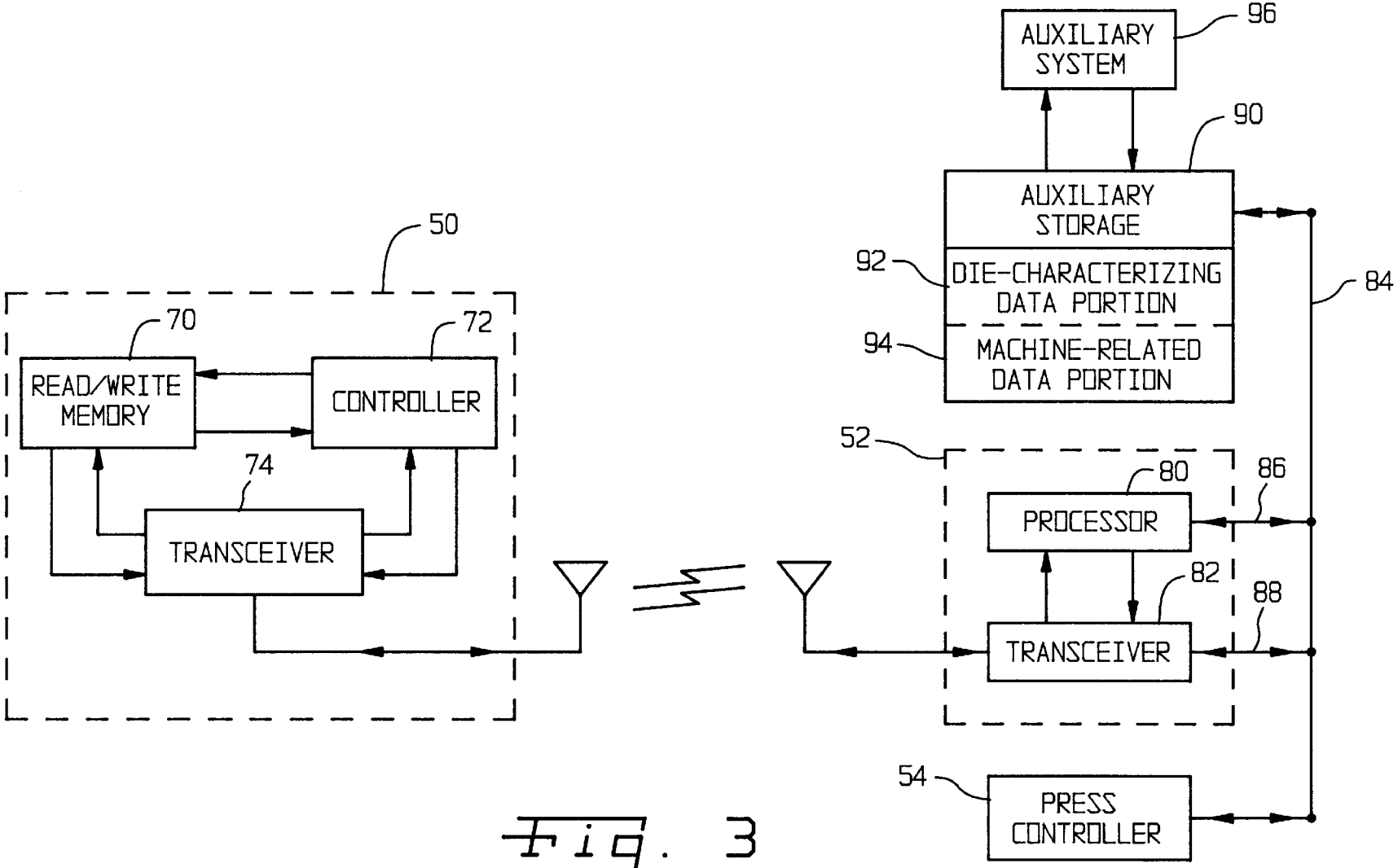
FIG. 3 is a block diagram depicting one illustrative embodiment of the tag-reader system of FIG. 2.

Referring now to FIG. 3, there is shown in block diagram format a tag-reader system depicting one illustrative embodiment of the arrangement disclosed in FIG. 2, in accordance with the present invention. The illustrated tag 50 includes, in integral combination, a read/write memory 70; an RF transceiver 74; and an on-tag controller 72 arranged for communication with both read/write memory 70 and transceiver 74. Controller 72, in one form thereof, is provided as a processor unit, preferably including an on-board programmer arranged to controllably conduct reprogramming operations in connection with read/write memory 70.

Data received by transceiver 74 is preferably provided to controller 72, which executes the proper data programming function with respect to read/write memory 70 and as indicated by the received data. For example, a typical data programming message transmitted by reader 52 to tag 50 may embody the subject data and the data processing instructions (i.e., type of data operation and/or target address in memory 70). Controller 72 decodes the programming message and implements the reprogramming activity respecting read/write memory 70 using the appropriate control signals and the supplied data. Conventional means are used to implement this programming feature of controller 72. Controller 72 may also be provided (e.g., in RAM) with a layout of the data types stored in read/write memory 70, hence introducing a "smart" feature into tag 50 that eliminates the need for reader 52 to provide information as to the location of data items to be affected by the indicated programming step; accordingly, in one form thereof, only the data and a data operation signifier need be communicated from reader 52, although as understood herein any means may be provided, either at tag 50 or reader 52, to implement the programming command feature. Additionally, controller 72 is effective in response to a data retrieval request for executing a read operation that accesses the data stored in read/write memory 70, retrieves the requested data item(s), and provides the retrieved data to transceiver 74 for transmission to reader 52. Optionally, data transfers may occur directly between read/write memory 70 and transceiver 74.

Referring again to FIG. 3, the illustrated reader 52 includes, in integral combination, an RF transceiver 82 and a processor 80 arranged for communication (e.g., data-transfer relationship) with transceiver 82. The components of reader 52 are arranged with signal lines 86, 88 to facilitate communications with press controller 54 over interconnecting signal bus 84 (e.g., an Allen-Bradley serial line). There is further provided, in association with reader 52, an auxiliary storage 90 connected to bus 84 and including a first data portion 92 for storing die-characterizing data and a second data portion 94 for storing machine-related data (e.g., die-dependent information). Auxiliary storage 90, in one form thereof, may serve as a source of information for transmission to tag 50 and a recipient of information retrieved from tag 50. It is within auxiliary storage 90, for example, that data intended for uploading to tag 50, for storage within its eventual destination of read/write memory 70, may be originally saved. This data may be provided to auxiliary storage 90 from an auxiliary system 96 connected thereto. Additionally, auxiliary storage 90 may serve as a site for receiving and storing information downloaded from tag 50, from which such information may be conveyed to auxiliary system 96. The auxiliary components and subsystems, in alternative forms thereof, may be arranged locally with the press machine or may be located remote from the machine site, e.g., in a networked environment including a central processing facility.

Types of auxiliary systems that are contemplated for use with the present invention include the following equipment:

Robot System/Feed—advances material into die;

Straightener—unwinds and flattens material;

Uncoiler—holds the coiled material; and

Plant Networks—could also attach to this network to keep track of production, schedule die maintenance, schedule. preventive maintenance, and capture and use other similar data The components arranged on the reader side of the illustrated system preferably establish, in one form thereof, a production monitoring system dedicated to formulating and maintaining the relevant information on reconfiguring the press machine and providing certain ones of the characterizing attributes for the installed die assembly (e.g., preventative maintenance records). The production monitoring system preferably communicates over bus 84 with press controller 54, which may illustratively be provided in the form of a relay-based limiting switch arrangement or a programmed logic controller (PLC) including, for example, an I/O bus and microprocessor configured as a computer.

APPENDIX A

| WORD | DESCRIPTION | REAL ADDRESS | "BUFFER" ADDRESS | |
|---|---|---|---|---|
| 0 | TOOL #LSW | F8:17 | N7:00 | FILE 2 |
| 1 | TOOL #MSW | | N7:01 | 10 WORDS |
| 2 | PRESS SERIAL NUMBER | N9:00 | N7:02 | |
| 3 | TOTAL PARTS MADE WITH DIE-LSW | C5:6.ACC | N7:03 | |
| 4 | TOTAL PARTS MADE WITH DIE-MSW | C5:7.ACC | N7:04 | |
| 5 | TOTAL PARTS MADE WITH DIE-LSW (PRESET VALUE) | F8:8 | N7:05 | |
| 6 | TOTAL PARTS MADE WITH DIE-MSW (PRESET VALUE) | | N7:06 | |
| 7 | RESERVED | | N7:07 | |
| 8 | RESERVED | | N7:08 | |
| 9 | RESERVED | | N7:09 | |
| 10 | START-UP SPEED | N10:18 | N11:00 | FILE 4 |
| 11 | CONTINUOUS SPEED | N10:19 | N11:01 | 5 WORDS |
| 12 | RESERVED | | N11:02 | |
| 13 | RESERVED | | N11:03 | |
| 14 | RESERVED | | N11:04 | |
| 15 | SHUTHEIGHT VALUE-LSW | F45:2 | N41:00 | FILE 7 |
| 16 | SHUTHEIGHT VALUE-MSW | | N41:01 | 6 WORDS |
| 17 | COUNTERBALANCE PRESSURE | N40:11 | N41:02 | |
| 18 | RESERVED | | N41:03 | |
| 19 | RESERVED | | N41:04 | |
| 20 | RESERVED | | N41:05 | |
| 21 | FEED LENGTH (LSW) | F175:0 | N171:00 | FILE 20 |
| 22 | FEED LENGTH (MSW) | | N171:01 | FEED & |

APPENDIX A-continued

| WORD | DESCRIPTION | REAL ADDRESS | "BUFFER" ADDRESS | |
|---|---|---|---|---|
| 23 | FEED RATE | N170:32 | N171:02 | STRN |
| 24 | FEED LINE HEIGHT | F175:10 | N171:03 | 10 WORDS |
| 25 | FEED STOCK GUIDE | F175:11 | N171:04 | |
| 26 | RESERVED | F175:12 | N171:05 | |
| 27 | ENTRY STRN ROLL | F175:13 | N171:06 | |
| 28 | CENTER STRN ROLL | F175:14 | N171:07 | |
| 29 | EXIT STRN ROLL | F175:15 | N171:08 | |
| 30 | STRN STOCK GUIDE | F175:16 | N171:09 | |
| 31 | RESERVED | | | |
| 32 | RESERVED | | | |
| 33 | RESERVED | | | |
| 34 | RESERVED | | | |
| 35 | RESERVED | | | |
| 36 | RESERVED | | | |
| 37 | RESERVED | | | |
| 38 | RESERVED | | | |
| 39 | RESERVED | | | |
| 40 | BLOWOFF "FROM" | N40:12 | N41:12 | |
| 41 | BLOWOFF "TO" | N40:13 | N41:13 | |
| 42 | STOCKGUIDE "FROM" | N40:14 | N41:14 | |
| 43 | STOCKGUIDE "TO" | N40:15 | N41:15 | |
| 44 | RESERVED | | | |
| 45 | RESERVED | | | |
| 46 | RESERVED | | | |
| 47 | RESERVED | | | |
| 48 | RESERVED | | | |
| 49 | RESERVED | | | |
| 50 | RESERVED | | | |
| 51 | AMCI RACK MOUNTED LIMIT SWITCH | N81:0 | N81:52 | FILE 11 |
| 52 | \| | | | AMCI |
| 53 | \| | | | RACK |
| 54 | \| | | | MOUNTED |
| 55 | \| | | | LIMIT |
| 56 | \| | | | SWITCH |
| 57 | \| | | | 52 WORDS |
| 58 | \| | | | |
| 59 | \| | | | |
| 60 | \| | | | |
| 61 | \| | | | |
| 62 | \| | | | |
| 63 | \| | | | |
| 64 | \| | | | |
| 66 | \| | | | |
| 67 | \| | | | |
| 68 | \| | | | |
| 69 | \| | | | |
| 70 | \| | | | |
| 71 | \| | | | |
| 72 | \| | | | |
| 73 | \| | | | |
| 74 | \| | | | |
| 75 | \| | | | |
| 76 | \| | | | |
| 77 | \| | | | |
| 78 | \| | | | |
| 79 | \| | | | |
| 80 | \| | | | |
| 82 | \| | | | |
| 83 | \| | | | |
| 84 | \| | | | |
| 86 | \| | | | |
| 87 | \| | | | |
| 88 | \| | | | |
| 89 | \| | | | |
| 90 | \| | | | |
| 91 | \| | | | |
| 92 | \| | | | |
| 93 | \| | | | |
| 94 | \| | | | |
| 95 | \| | | | |
| 96 | \| | | | |
| 97 | \| | | | |
| 98 | \| | | | |
| 99 | \| | | | |
| 100 | \| | | | |
| 101 | ↓ | | | |

APPENDIX A-continued

| WORD | DESCRIPTION | REAL ADDRESS | "BUFFER" ADDRESS | |
|---|---|---|---|---|
| 102 | END OF AMCI LIMIT SWITCH | N81:51 | N81:103 | |
| 103 | | | | |
| 104 | | | | |
| 105 | | | | |
| 106 | | | | |
| 107 | | | | |
| 108 | | | | |
| 109 | | | | |
| 110 | AMCI RACK MOUNTED DIE PROTECTION | N91:0 | N91:54 | FILE 12 |
| 111 | | | | AMCI |
| 112 | | | | RACK |
| 113 | | | | MOUNTED |
| 114 | | | | DIE |
| 115 | | | | PROTECTION |
| 116 | | | | 54 WORDS |
| 117 | | | | |
| 118 | | | | |
| 119 | | | | |
| 120 | | | | |
| 121 | | | | |
| 122 | | | | |
| 123 | | | | |
| 124 | | | | |
| 125 | | | | |
| 126 | | | | |
| 127 | | | | |
| 128 | | | | |
| 129 | | | | |
| 130 | | | | |
| 131 | | | | |
| 132 | | | | |
| 133 | | | | |
| 134 | | | | |
| 135 | | | | |
| 136 | | | | |
| 137 | | | | |
| 138 | | | | |
| 139 | | | | |
| 140 | | | | |
| 141 | | | | |
| 142 | | | | |
| 143 | | | | |
| 144 | | | | |
| 145 | | | | |
| 146 | | | | |
| 147 | | | | |
| 148 | | | | |
| 149 | | | | |
| 150 | | | | |
| 151 | | | | |
| 152 | | | | |
| 153 | | | | |
| 154 | | | | |
| 155 | | | | |
| 156 | | | | |
| 157 | | | | |
| 158 | | | | |
| 159 | | | | |
| 160 | | | | |
| 161 | | | | |
| 162 | ↓ | | | |
| 163 | END OF AMCI DIE PROTECTION | N91:53 | N91:107 | |
| 164 | | | | |
| 165 | | | | |
| 166 | | | | |
| 167 | | | | |
| 168 | | | | |
| 169 | | | | |
| 170 | LOW ALARM INHIBIT | N100:11 | N101:00 | FILE 13 |
| 171 | SAMPLE COUNT | N100:12 | N101:01 | LOAD |
| 172 | LOOK WINDOW (FROM) | N100:13 | N101:02 | MONITOR |
| 173 | LOOK WINDOW (TO) | N100:14 | N101:03 | 25 WORDS |
| 174 | RESERVED | N100:15 | N101:04 | |
| 175 | RESERVED | N100:16 | N101:05 | |
| 176 | CH1 LOW CAPACITY | N107:11 | N101:06 | |
| 177 | CH1 HIGH CAPACITY | N107:12 | N101:07 | |

APPENDIX A-continued

| WORD | DESCRIPTION | REAL ADDRESS | "BUFFER" ADDRESS |
|---|---|---|---|
| 178 | CH1 LOW TREND | N107:13 | N101:08 |
| 179 | CH1 HIGH TREND | N107:14 | N101:09 |
| 180 | CH2 LOW CAPACITY | N107:15 | N101:10 |
| 181 | CH2 HIGH CAPACITY | N107:16 | N101:11 |
| 182 | CH2 LOW TREND | N107:17 | N101:12 |
| 183 | CH2 HIGH TREND | N107:18 | N101:13 |
| 184 | CH3 LOW CAPACITY | N108:11 | N101:14 |
| 185 | CH3 HIGH CAPACITY | N108:12 | N101:15 |
| 186 | CH3 LOW TREND | N108:13 | N101:16 |
| 187 | CH3 HIGH TREND | N108:14 | N101:17 |
| 188 | CH4 LOW CAPACITY | N108:15 | N101:18 |
| 189 | CH4 HIGH CAPACITY | N108:16 | N101:19 |
| 190 | CH4 LOW TREND | N108:17 | N101:20 |
| 191 | CH4 HIGH TREND | N108:18 | N101:21 |
| 192 | LOAD MONITOR MODE | B102:0 | N101:22 |
| 193 | RESERVED | | N101:23 |
| 194 | RESERVED | | N101:24 |
| 195 | | | |
| 196 | | | |
| 197 | | | |
| 198 | | | |
| 199 | | | |
| 200 | | | |
| 201 | | | |
| 202 | | | |
| 203 | | | |
| 204 | | | |
| 205 | | | |

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A tag associated with a die assembly of a machine, said tag comprising:

a reprogrammable memory; and communication means for transmitting data provided by said reprogrammable memory and for receiving data for providing to said reprogrammable memory, said communication means adapted to transmit and receive data from the die assembly;

wherein data provided to said tag for storage in said reprogrammable memory includes die information pertaining to operational parameters of the machine adapted for configuration of the machine therewith.

2. The tag as recited in claim 1, wherein the die information associated with said die assembly further comprises:

information pertaining to press operation such as auxiliary equipment, motor load, feed analysis data, and die protection set points, said information pertaining to operational parameters of the machine adapted for configuration of the machine therewith.

3. The tag as recited in claim 2, further comprising:

the machine comprises at least one press machine operatively configurable with said die assembly; and machine information pertaining to operational parameters of said at least one press machine.

4. The tag as recited in claim 1, wherein said reprogrammable memory further comprises:

a read/write memory.

5. The tag as recited in claim 1, wherein said communication means includes a wireless communications capability.

6. The tag as recited in claim 1, further comprises:

means for selectively reprogramming said reprogrammable memory using the data received by said communication means.

7. A tag associated with a die assembly for a machine, said tag comprising:

first means for storing data in a modifiable manner; and second means for transmitting data provided by said first means and for receiving data for said first means;

wherein data provided to said tag for storage in said first means includes die information associated with said die assembly, said die information pertaining to operational parameters of the machine adapted for configuration of the machine therewith.

8. The tag as recited in claim 7, wherein said die information associated with said die assembly further comprises:

information pertaining to press operation such as auxiliary equipment, motor load, feed analysis data, and die protection set points, said information pertaining to operational parameters of the machine adapted for configuration of the machine therewith.

9. The tag as recited in claim 7, wherein the data stored by said first means further comprises:

the machine comprises at least one press machine operatively configurable with said die assembly; and machine information pertaining to operational parameters of said at least one press machine.

10. The tag as recited in claim 7, wherein said first means comprises:

a read/write memory.

11. The tag as recited in claim 10, wherein said second means comprises:

a wireless communications device.

12. The tag as recited in claim 10, further comprises:

a processor to selectively modify the contents of said first means using the data received by said second means.

13. A tag apparatus associated with a die assembly of a machine, said tag apparatus comprising:

a read/write memory; and a communications device being arranged in data-transfer relationship with said read/write memory and having a transmit/receive capability;

wherein data received by said communications device for transfer to said read/write memory includes die information pertaining to operational parameters of the machine adapted for configuration of the machine therewith.

14. The tag as recited in claim 13, wherein the die information associated with said die assembly further comprises:

information pertaining to press operation such as auxiliary equipment, motor load, feed analysis data, and die protection set points, said information pertaining to operational parameters of the machine adapted for configuration of the machine therewith.

15. The tag apparatus as recited in claim 14, wherein the data stored by said read/write memory further comprising:

the machine comprises at least one press machine operatively configurable with said die assembly; and machine information pertaining to operational parameters of said at least one press machine.

16. The tag apparatus as recited in claim 13, wherein said communications device includes a wireless transmit/receive operating capability.

17. The tag apparatus as recited in claim 13, further comprises:

a processor to selectively reprogram the contents of said read/write memory using data received by said communications device.

18. A tag associated with a die assembly of a machine, said tag comprising:

a storage means for reprogrammably storing data; and a communications device being adapted to transmit data provided by said storage means and being adapted to receive data for providing to said storage means;

wherein data provided to said tag for storage in said storage means includes die information pertaining to operational parameters of the machine adapted for configuration of the machine therewith.

19. The tag as recited in claim 18, wherein the die information associated with said die assembly further comprises:

information pertaining to press operation such as auxiliary equipment, motor load, feed analysis data, and die protection set points, said information pertaining to operational parameters of the machine adapted for configuration of the machine therewith.

20. The tag as recited in claim 18, further comprises:

the machine comprises at least one press machine; and said data comprises machine information pertaining to operational parameters of said at least one press machine, said press machine operatively configurable with said die assembly.

21. The tag as recited in claim 18, wherein said storage means further comprises:

a read/write memory.

22. The tag as recited in claim 21, wherein said communications device includes a wireless transmit/receive operating capability.

23. The tag as recited in claim 18, further comprises:

means for selectively reprogramming said storage means using the data received by said communications device.

24. A system for use with a press machine, said press machine being associated with a die assembly, said system comprising:

a tag integrally associated with said die assembly, said tag comprising:

a reprogrammable memory, wherein data provided to said tag for storage in said reprogrammable memory including die information pertaining to operational parameters of the press machine for configuration of the press machine therewith, and a communications device arranged in data-transfer relationship with said reprogrammable memory and having a transmit/receive capability; and communication means associated with said press machine and arranged to establish with the communications device of said tag a bi-directional communications link.

25. The system as recited in claim 24, wherein the die information associated with said die assembly further comprises:

information pertaining to press operation such as auxiliary equipment, motor load, feed analysis data, and die protection set points, said information pertaining to operational parameters of the press machine adapted for configuration of the press machine therewith.

26. The system as recited in claim 25, wherein the data stored by said reprogrammable memory further comprises:

machine information representing characterizing attributes of at least one press machine operatively configurable with said die assembly.

27. The system as recited in claim 24, wherein the communications device of said tag and the communication means associated with said press machine establish a wireless link.

28. The system as recited in claim 24, wherein said reprogrammable memory further comprises:

a read/write memory.

29. The system as recited in claim 28, further comprises:

means, arranged for communication with a press controller associated with said press machine, for providing said communication means with die information associated with said die assembly for transmission to said tag.

30. A system for use with a press machine, said press machine being associated with a die assembly, said system comprising:

a tag integrally associated with said die assembly, said tag comprising:

first means for storing data in a modifiable manner, wherein data provided to said tag for storage in said first means including die information pertaining to operational parameters of the press machine for configuration of the press machine therewith, and second means for transmitting data provided by said first means and for receiving data for said first means; and a reader associated with said press machine, said reader comprising:

third means arranged to establish with the second means of said tag a bi-directional communications link.

31. The system as recited in claim 30, wherein the die information associated with said die assembly further comprises:

information pertaining to press operation such as auxiliary equipment, motor load, feed analysis data, and die protection set points, said information pertaining to operational parameters of the press machine adapted for configuration of the press machine therewith.

32. The system as recited in claim 31, wherein the data stored by said first means further comprises:

machine information representing characterizing attributes of at least one press machine operatively configurable with said die assembly.

33. The system as recited in claim 30, wherein the first means of said tag comprises:

a read/write memory.

34. The system as recited in claim 33, wherein the second means of said tag and the third means of said reader establish a wireless communications link.

35. The system as recited in claim 30, further comprises:

a processor, associated with said tag, to selectively modify the contents of said first means using the data received by said second means.

36. The system as recited in claim 30, wherein said reader further comprises:

fourth means, arranged for communication with a press controller associated with said press machine, for providing the third means of said reader with die information associated with said die assembly for transmission to said tag.

37. An apparatus for use with a press machine, said press machine being associated with a die assembly, said apparatus comprising:

a read/write memory integrally associated with said die assembly, wherein data provided to said read/write memory for storage therein including die information pertaining to operational parameters of the press machine for configuration of the press machine therewith;

a first communications device integrally associated with said die assembly, said first communications device being arranged in data communicative relationship with said read/write memory and having a transmit/receive capability; and a second communications device associated with said press machine, said second communications device being arranged to provide a bi-directional communications link with said first communications device.

38. The apparatus as recited in claim 37, wherein the die information associated with said die assembly further comprises:

information pertaining to press operation such as auxiliary equipment, motor load, feed analysis data, and die protection set points, said information pertaining to operational parameters of the press machine adapted for configuration of the press machine therewith.

39. The apparatus as recited in claim 38, wherein the data stored by said read/write memory further comprises:

machine information representing characterizing attributes of at least one press machine operatively configurable with said die assembly.

40. The apparatus as recited in claim 37, wherein the bi-directional communications link provided by said first communications device and said second communications device includes a wireless link.

41. The apparatus as recited in claim 37, further comprises:

a processor integrally associated with said second communications device and arranged for communication with a press controller associated with said press machine.

42. The apparatus as recited in claim 41, further comprises:

an auxiliary storage device arranged to selectively receive data received by said second communications device from said first communications device.

43. A system for use with a press machine, said press machine being associated with a die assembly, said system comprising:

a tag integrally associated with said die assembly, said tag comprising:

a storage means for reprogrammably storing data, wherein data provided to said tag for storage in said storage means includes die information pertaining to operational parameters of the press machine for configuration of the press machine therewith, and a first transmit/receive communications means arranged in data-transfer relationship with said storage means; and a reader associated with said press machine, said reader comprising:

a second transmit/receive communications means arranged to establish with the first transmit/receive communications means of said tag a bi-directional communications link.

44. The system as recited in claim 43, wherein the die information associated with said die assembly further comprises:

information pertaining to press operation such as auxiliary equipment, motor load, feed analysis data, and die protection set points, said information pertaining to operational parameters of the press machine adapted for configuration of the press machine therewith.

45. The system as recited in claim 44, wherein the data stored by said storage means further comprises:

machine information representing characterizing attributes of at least one press machine operatively configurable with said die assembly.

46. The system as recited in claim 43, wherein the first transmit/receive communications means of said tag and the second transmit/receive communications means of said reader establish a wireless link.

47. The system as recited in claim 43, wherein said storage means further comprises:

a read/write memory.

* * * * *